US006662980B1

(12) United States Patent
Hickle et al.

(10) Patent No.: US 6,662,980 B1
(45) Date of Patent: Dec. 16, 2003

(54) VACUUM CONTROL AND AIR RESTRICTION BARRIER FOR A GARMENT PRESS

(75) Inventors: Ernest J. Hickle, New Market, TN (US); David G. Crockett, Morristown, TN (US)

(73) Assignee: Forenta, LP, Morristown, TN (US)

( * ) Notice: Subject to any disclaimer, the term of this patent is extended or adjusted under 35 U.S.C. 154(b) by 2 days.

(21) Appl. No.: 10/167,024

(22) Filed: Jun. 11, 2002

(51) Int. Cl.[7] ..... D06C 15/00
(52) U.S. Cl. ..... 223/57
(58) Field of Search ..... 223/57, 51, 52; 38/66, 14

(56) References Cited

U.S. PATENT DOCUMENTS

| | | | | |
|---|---|---|---|---|
| 2,143,928 A | * | 1/1939 | Troy | 38/2 |
| 2,338,601 A | * | 1/1944 | Rumbaugh | 38/64 |
| 2,521,512 A | * | 9/1950 | Gayring | 38/15 |
| 2,850,218 A | * | 9/1958 | Gibson et al. | 223/30 |
| 3,471,067 A | | 10/1969 | Stewart | |
| 4,351,457 A | * | 9/1982 | Engelbart | 223/57 |
| 4,473,961 A | | 10/1984 | Frushtick | |
| 5,148,955 A | | 9/1992 | Cares | |
| 5,474,216 A | | 12/1995 | Harrod et al. | |
| 5,692,326 A | | 12/1997 | Mohan et al. | |
| 5,732,859 A | | 3/1998 | LeBlanc | |
| 6,237,261 B1 | | 5/2001 | Hickle et al. | |

* cited by examiner

*Primary Examiner*—John J. Calvert
*Assistant Examiner*—James Smith
(74) *Attorney, Agent, or Firm*—Pitts & Brittian, P.C.

(57) ABSTRACT

A vacuum control barrier and buck cover system for positioning on the press buck of a garment press for reducing the force of the vacuum applied to a portion of a garment by the press buck. The vacuum control barrier includes a barrier sheet dimensioned to cover at least a substantial portion of the air pervious surface of the rear portion of the press buck through which a vacuum is applied to a garment such that the barrier sheet reduces or eliminates the force of the vacuum applied to the garment through the air pervious surface of the rear portion of the press buck relative to the vacuum force applied to the garment through the air pervious surface of the front portion of the press buck. The buck cover system includes a front cover portion for covering at least a substantial portion of the air pervious surface of the front portion of the press buck, and a rear cover portion for covering at least a substantial portion of the air pervious surface of the rear portion of the press buck. The rear cover portion is substantially less air pervious than the front cover portion such that a vacuum of lesser force is applied to the garment through the rear cover portion than the vacuum applied to the garment through the front cover portion.

21 Claims, 3 Drawing Sheets

VACUUM CONTROL AND AIR RESTRICTION BARRIER FOR A GARMENT PRESS

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to the field of garment or shirt body presses, and more particularly to a vacuum control barrier and buck cover system for controlling the vacuum applied to a garment by a mannequin or buck of a garment press.

2. Description of the Related Art

Garment presses, and, more particularly, shirt body presses, have been used in the dry cleaning and laundering field to quickly and effectively press a garment or shirt body. A conventional shirt body press includes at least one mannequin or press buck upon which the shirt is supported, and includes forward and rearward pressing plates for pressing the shirt body therebetween. In order to facilitate the positioning of the shirt, i.e. the dressing of the shirt, on the mannequin or buck prior to pressing, the buck is typically provided with a front surface which is perforated, or otherwise air pervious. The rear surface of the buck is typically air pervious, or is composed of a material that is less pervious to air passage than the front surface. A vacuum is selectively applied to the interior of the buck such that the vacuum communicated through the perforated front surface of the buck draws the fabric of the front of the shirt to the front surface of the buck and holds the fabric tightly in place against the front surface. Thus, as the operator of the shirt body press adjusts the position of the shirt on the press buck, the fabric of the front of the shirt is held in place on the buck by the vacuum.

Further, some shirt body presses have air bags which are positioned at opposite sides of the buck. These air bags are inflated with air to stretch the shirt body so as to remove wrinkles and so as to hold the shirt body in place while the press plates close. Accordingly, during operation of a conventional shirt body press the shirt is dressed or positioned on the buck with the assistance of the vacuum generated at the front surface of the buck. When the shirt has been properly positioned on the buck, with the shirt thereon, it is moved into position between the forward and rearward pressing plates. The air bags are then inflated and the pressing plates moved into contact with the shirt. The vacuum is maintained to hold the front of the shirt so that it does not become distorted while the air bags are inflating. The vacuum is terminated as soon as the pressure plates come into contact with the shirt. Various prior art pressing devices are disclosed in the following patents: U.S. Pat. No. 3,471,067, issued to Stewart on Oct. 7, 1969; U.S. Pat. No. 4,473,961, issued to Frushtick on Oct. 2, 1984; U.S. Pat. No. 5,148,955, issued to Cares on Sep. 22, 1992; U.S. Pat. No. 5,474,216, issued to Harrod, et al., on Dec. 12, 1995; U.S. Pat. No. 5,692,326, issued to Mohan, et al., on Dec. 2, 1997; U.S. Pat. No. 5,732,859, issued to LeBlanc on Mar. 31, 1998; and U.S. Pat. No. 6,237,261 B1, issued to Hickle, et al., on May. 29, 2001.

Whereas the above described shirt body presses are useful in simplifying the pressing of shirts, the dressing operation, whereby the shirt is positioned on the press buck, has remained difficult. In this regard, the operator typically stands facing the front surface of the buck when placing the shirt on the buck. Although the vacuum generated at the front surface of the buck is helpful in holding the fabric of the shirt in place once positioned, the vacuum leaks through the padding and migrates to the rear surface of the buck, making the job of initially positioning the shirt difficult. During the initial positioning of the shirt, the fabric of the shirt back is drawn and held to the rear surface of the buck before it is in the proper position such that the operator is required to reach around the buck to smooth out wrinkles and pull the shirt back into position. Further, the vacuum that leaks through the padding and migrates to the rear buck surface reduces the amount of vacuum that is applied to the front buck surface and thus reduces the vacuum holding power on the front of the shirt. This reduction in vacuum holding power can cause wrinkles to be created when the side air bags are inflated.

Therefore, it is an object of the present invention to provide a vacuum control barrier and buck cover system for a garment press which makes it easier for the operator to place a garment, such as a shirt, on the press buck of the garment press.

Another object of the present invention is to provide a vacuum control barrier and buck cover system for a garment press which reduces, or eliminates, the vacuum at the rear surface the press buck such that a shirt can be more easily positioned on the press buck of the garment press.

A further object of the present invention is to provide a vacuum control barrier and buck cover system for a garment press which reduces, or eliminates, the vacuum at the rear surface of the press buck such that there is less possibility creating wrinkles to the back of a garment.

Yet another object of the present invention is to provide a vacuum control barrier and buck cover system for a garment press which is easy and inexpensive to manufacture.

BRIEF SUMMARY OF THE INVENTION

Other objects and advantages will be accomplished by the present invention which provides a vacuum control barrier and buck cover system for controlling the vacuum applied to a garment by a press buck of a garment press. The vacuum control barrier of the present invention is designed to be positioned on the press buck of a garment press, the press buck having front and rear portions, the front portion provided with an air pervious surface through which a vacuum is applied to a garment positioned on the press buck, and the rear portion being generally pervious to air passage. The vacuum control barrier includes a barrier sheet dimensioned to cover at least a substantial portion of the rear, the sides, and the outer portion of the front of the press buck such that the barrier sheet reduces or eliminates the force of the vacuum that leaks and migrates to the rear of the press buck relative to the force applied to the garment through the air pervious surface of the front portion of the buck.

The cover system of the present invention includes a front cover portion for covering a portion of the outer edges of the air pervious surface of the front portion of the press buck, with the substantial central portion of the front cover being omitted such that the vacuum applied to the garment through the air pervious surface of the front portion of the buck is communicated through the omitted central portion of the front cover. The cover system also includes a rear cover portion for covering at least a substantial portion of the rear portion of the press buck, with the rear cover portion being less air pervious than the front cover portion, therefore the vacuum applied to the garment over the rear portion of the press buck is of a lesser force than the vacuum applied to the garment through the front cover portion covering the front portion of the buck. This reduction of vacuum on the rear of the buck will increase the vacuum holding power on the front surface which will further enhance the pressing and finishing process. As will be discussed in detail below, the reduction of the vacuum applied to the garment at the rear portion of the press buck facilitates the proper positioning of a garment on the press buck, and reduces operator time in removing wrinkles from the rear of the garment during the pressing operation.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
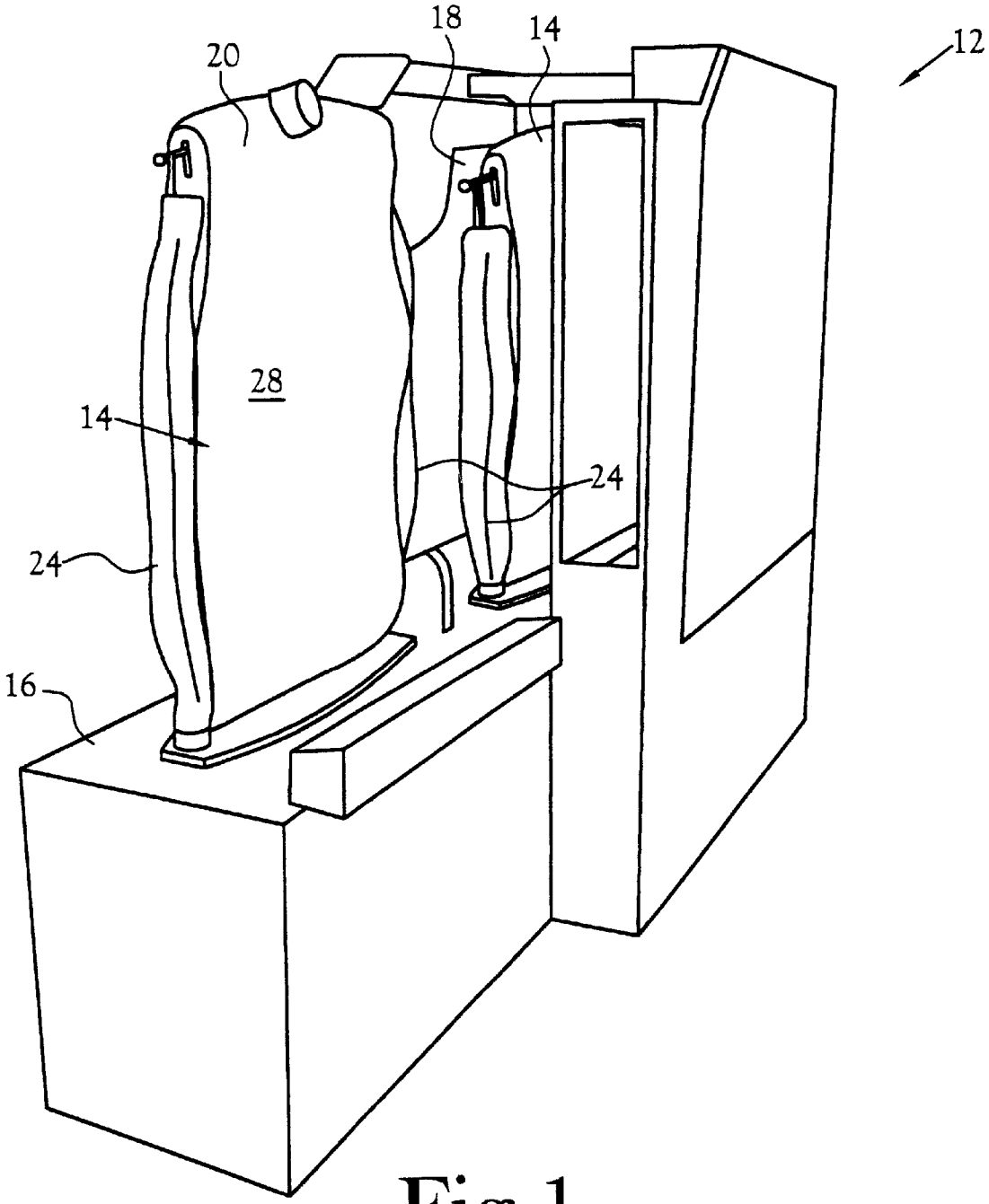
Fig. 1 (PRIOR ART)
FIG. 1 is a perspective view of prior art garment press of the type on which a vacuum control barrier, or buck cover system, of the present invention would be installed and used.
Figure 4:
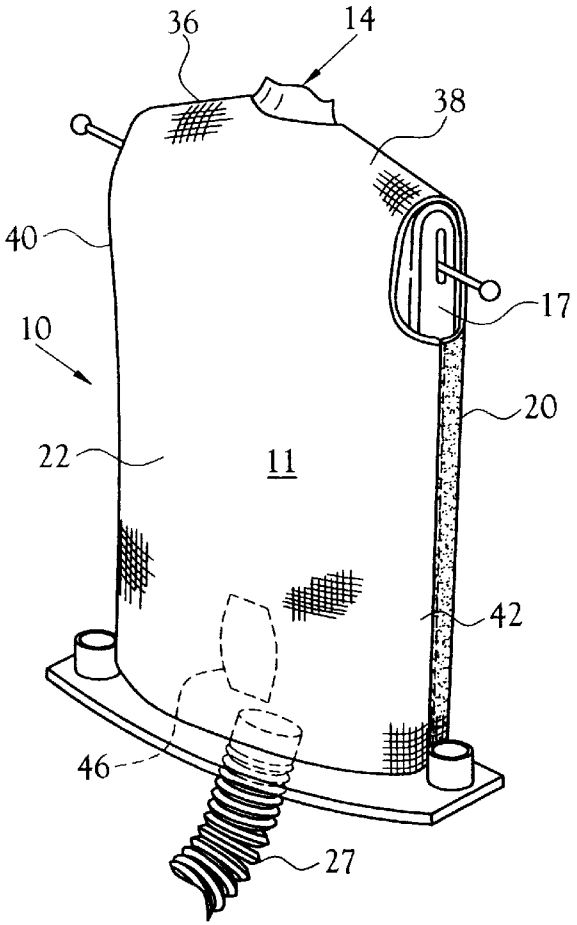
FIG. 4 is a perspective view of a vacuum control barrier of the present invention mounted on the shirt buck of a garment press.
Figure 3:
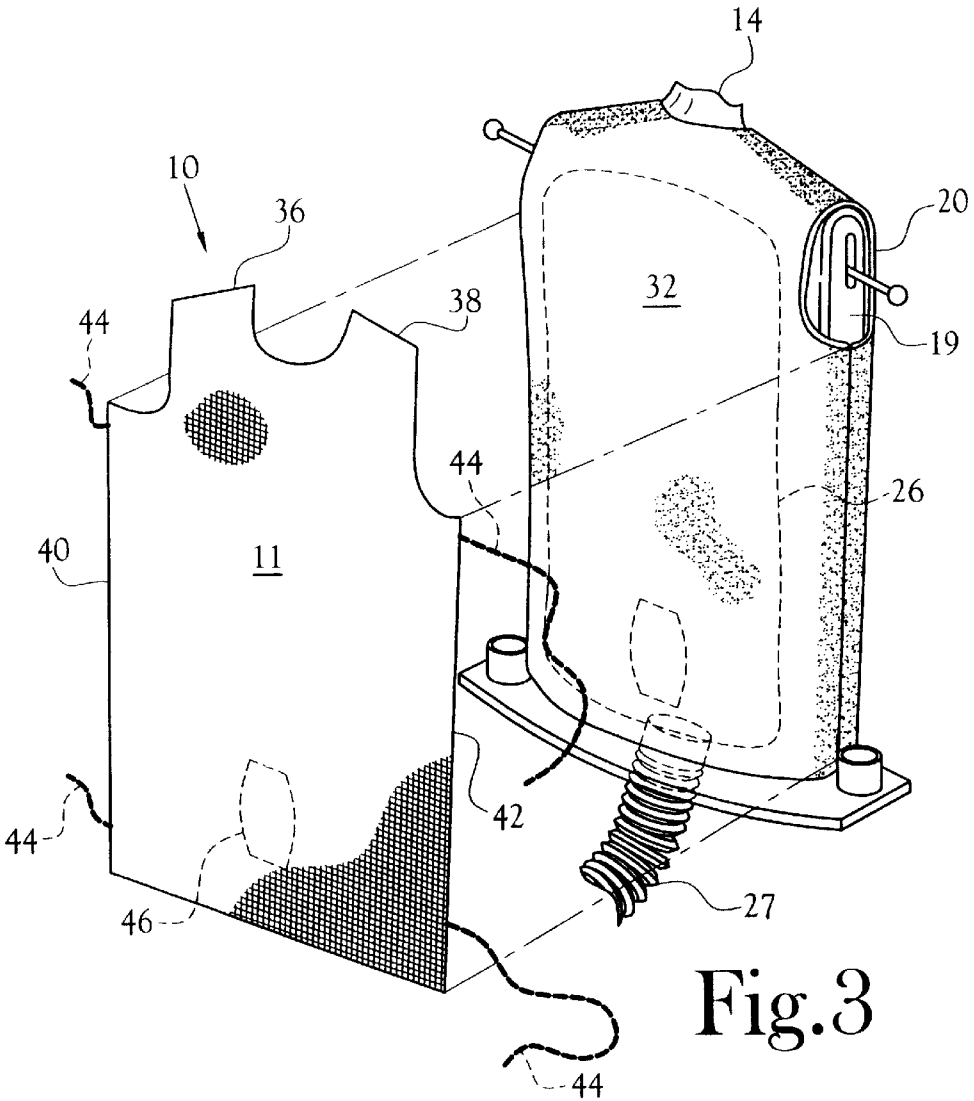
FIG. 3 is an exploded perspective view of a vacuum control barrier of the present invention and a shirt buck of a garment press.

A vacuum control barrier of the present invention is illustrated at 10 in FIGS. 3 and 4. However, in order to facilitate the following description of the invention and its use, a typical shirt body press 12 is illustrated in FIG. 1. It will be understood that the shirt body press 12 is merely representative of one conventional garment press with which the vacuum control barrier of the present invention can be used. As illustrated, a conventional garment press, such as the press 12, includes at least one mannequin, or press buck 14, which is positioned on a support frame 16 and is movable to a position between a rear press plate 18 and a front press plate (not shown). Accordingly, a shirt is positioned on the buck 14, and selectively moved to a position between the press plates, and the press plates are moved into contact with the shirt, thereby pressing the shirt.

Figure 2:
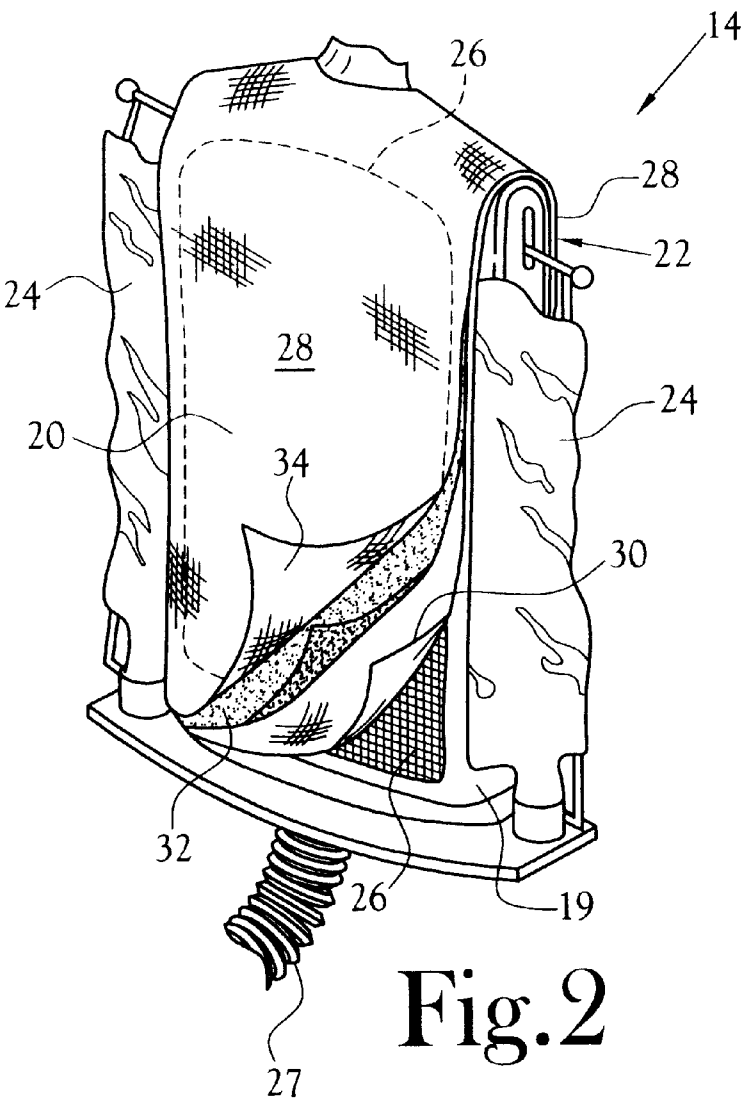
FIG. 2 is a front perspective view of a prior art shirt buck of a garment press with a cover system mounted thereon.

As is more clearly illustrated in FIG. 2, each press buck 14 of the conventional press 12 defines a body 19 having a front portion 20 and a rear portion 22, and is dimensioned to receive and support a shirt body (not shown) during the pressing operation. Each buck 14 also includes inflatable side air bags 24 at each side of the body 19. The air bags 24 are inflated with air prior to the press plates 18 being moved into contact with the shirt body in order to remove wrinkles in the shirt body, and the air bags 24 remain inflated during the actual pressing of the shirt. The conventional press buck 14 is also provided with surfaces 26 which cover at least a substantial portion of the front 20 of the buck 14 and are air pervious (the air pervious surface of the front portion is shown by cross-hatching and in phantom), and a conduit 27 communicating with the interior of the buck 14 is provided such that a vacuum can be applied to the interior of the buck 14. Typically the air pervious front surface 26 is defined by wire mesh, metal screens, perforated plates, or the like, and it will be recognized that, when a vacuum is applied to the interior of the buck 14, a vacuum is generated at the front surface 26. The vacuum is generated at the front surface 26 and is used to hold the shirt body in the desired position on the buck 14 prior to the actual pressing of the shirt body by the press plates 18.

In order to facilitate the pressing operation, and to minimize potential damage to the garment being pressed, and to reduce wrinkling of the garment, the buck 14 is also provided with a cover system which provides a cushioned surface between the buck 14 and the shirt body. Various cover systems are used with garment presses, but the cover system illustrated at 28 in FIG. 2 is illustrative of a typical system. The cover system 28 includes a base pad 30 of woven material which substantially covers the front and rear portions 20 and 22 of the buck 14, and a flannel layer 32 which overlays the base pad 30. An outer cover 34 is also provided which typically comprises fabric material to which side air bags, and in some instances a top air bag, are attached. It will be understood that the base pad 30, flannel layer 32 and outer cover 34, of the cover system 28 are all air pervious such that the vacuum generated in the buck 14 is communicated to the surface of the outer cover 34. Further, in conventional cover systems the same materials cover the front and rear portions 20 and 22 of the buck 14 such that the force of the vacuum applied to the front and back of a shirt positioned on the buck 14 is substantially greater on the front surface.

Referring now to FIGS. 3 and 4, the vacuum control barrier of the present invention is illustrated at 10. The vacuum control barrier 10 defines a barrier sheet 11 which is dimensioned to cover at least a substantial portion of the air pervious surface of the rear portion 22 of the buck 14, and, in the illustrated preferred embodiment the control barrier 10, the barrier sheet 11 is dimensioned to cover the entire rear portion 22. In this regard, the barrier sheet 11 defines opposite shoulder portions 36 and 38, which are received over the shoulder portions of the buck, overlapping onto the front portion 20 slightly, and opposite side portions 40 and 42 which extend around the sides of the buck 14, overlapping slightly onto the front portion 20 of the buck 14. Further, the barrier sheet 11 is fabricated from a sheet of material which either partially, or completely, restricts vacuum air flow that otherwise would leak or migrate to the rear portion 22 and a shirt body mounted on the buck 14. In one preferred embodiment, the barrier sheet 11 defines a closely woven material, such as a closely woven spun nylon fabric, which reduces, but does not completely block migrating flow of air to the rear portion 22 and a shirt body mounted on the buck 14. Thus, by positioning the control barrier 10 over the surface 26 of the rear portion 22, the force of the vacuum applied to the back of a shirt body is decreased, or eliminated, and the force of the vacuum applied to the front portion of the shirt body is increased for a more effective holding of the shirt front. Moreover, by preselecting the fabricating material used to make the control barrier 10 the disparity between the vacuum force applied to the front portion of the shirt body and the back of the shirt can be altered. For example, if a greater disparity is desired, a less air pervious fabricating material can be used, and if no vacuum is desired an air impervious fabricating material can be used. One alternative fabricating material includes a material that is permeable to moisture, but substantially reduces the flow of air through the rear portion 22.

Preferably the control barrier 10 becomes a component of the cover system 28. It may be laid in place between outer cover 34 and flannel layer 32 or sewn to either cover 34 or flannel layer 32. However, it will be understood that various releasable fasteners, such as the illustrated ties 44, could be used to releasably secure the barrier 10 to the buck 14. Moreover, it is contemplated that the present invention can comprise a multilayer cover system wherein the layers of the rear portion of the cover system are less pervious to air than the layers of the front portion of the cover system. For example, in a cover system having the basic components of the system 28 illustrated in FIG. 2, the rear portion of the flannel layer 32 can be made less pervious to air than the front portion by using a flannel with a tighter weave for the rear portion of the flannel layer 32. In this regard, a primary objective of the vacuum control barrier and the cover system of the present invention is to reduce or eliminate the vacuum force applied to the back of the shirt body relative to that being applied to the front of the shirt body. By reducing or eliminating the vacuum force applied to the back of the shirt body the dressing of the shirt body on the buck 14 is made much easier. In this regard, when dressing a shirt on the buck 14 the operator typically stands facing the front portion 20 of the buck 14 when placing the shirt on the buck 14 such that the operator must reach around the buck 14 to access the rear portion 22 of the buck 14 to position and remove wrinkles from the shirt back. When a strong vacuum is applied to the shirt back, properly positioning and removing wrinkles from the shirt back while standing in front of the buck 14 is difficult, and excessive movement of the fabric of the shirt back against the pull of the vacuum can wrinkle the shirt. Reducing or removing the vacuum applied to the shirt back makes it easier for someone standing in front of the buck 14 to properly position the shirt back without excessive work by the operator. Because of the operator's greater access to the front of the shirt, the relatively stronger vacuum does not result in problems in the positioning of the shirt. The stronger vacuum applied to the front of the shirt actually facilitates the pressing of the shirt front and helps to insure that the shirt back remains properly positioned on the buck 14. It is, however, contemplated that the control barrier 10 can be provided with an opening therethrough, such as the opening shown at 46 in FIGS. 3 and 4, which allows migrating vacuum to be applied to the tail of the shirt to insure that it is held in position, notwithstanding the reduction in the vacuum force applied to other portions of the shirt back.

While a preferred embodiment has been shown and described, it will be understood that it is not intended to limit the disclosure, but rather it is intended to cover all modifications and alternate devices and methods falling within the spirit and the scope of the invention as defined in the appended claims.

Having thus described the aforementioned invention, we claim:

1. A vacuum control barrier for a press buck of a garment press, the press buck having a front portion provided with an air pervious surface through which a vacuum is applied to a garment positioned on the press buck, and having a rear portion provided with an air pervious surface through which a vacuum is applied to a garment positioned on the press buck, said control barrier comprising:

a barrier sheet dimensioned to cover at least a substantial portion of the air pervious surface of the rear portion of the press buck, wherein said barrier sheet reduces the force of the vacuum applied to the garment through the air pervious surface of the rear portion of the press buck relative to the force applied to the garment through the air pervious surface of the front portion of the press buck.

2. The vacuum control barrier of claim 1 wherein said barrier sheet is provided with securing means for securing said barrier sheet to said press buck.

3. The vacuum control barrier of claim 1 for use on a press buck having opposite shoulder portions and opposite side portions, wherein said barrier sheet defines opposite shoulder portions which are received over the shoulder portions of the buck, and defines opposite side portions which extend at least partially around the side portions of the press buck.

4. The vacuum control barrier of claim 3 wherein said barrier sheet is provided with securing means for securing said barrier sheet to said press buck.

5. The vacuum control barrier of claim 1 for use on a press buck provided with a cover system secured to said press buck, wherein said barrier sheet is secured to the press buck by securing said barrier sheet to said cover system.

6. The vacuum control barrier of claim 5 for use on a press buck having opposite shoulder portions and opposite side portions, wherein said barrier sheet defines opposite shoulder portions which are received over the shoulder portions of the buck, and defines opposite side portions which extend at least partially around the side portions of the press buck and which are secured to the cover system.

7. The vacuum control barrier of claim 6 wherein said shoulder portions of said barrier sheet are secured to the cover system.

8. The vacuum control barrier of claim 1 wherein said barrier sheet is fabricated of a woven material.

9. The vacuum control barrier of claim 8 wherein said woven material is a spun nylon fabric.

10. The vacuum control barrier of claim 7 wherein said barrier sheet is fabricated of a woven material.

11. The vacuum control barrier of claim 10 wherein said woven material is a spun nylon fabric.

12. The vacuum control barrier of claim 1 wherein said barrier sheet is fabricated of a material that is permeable to moisture, but is substantially impervious to the flow of air therethrough.

13. A cover system for a press buck of a garment press, the press buck having a front portion provided with an air pervious surface through which a vacuum is applied to a garment positioned on the press buck, and having a rear portion provided with an air pervious surface through which a vacuum migrates as the vacuum is applied to a garment positioned on the press buck, said cover system comprising:

a front cover portion for covering at least a substantial portion of the air pervious surface of the front portion of the press buck, said front cover portion being air pervious, wherein the vacuum applied to the garment through the air pervious surface of the front portion of the press buck is communicated through said front cover portion; and a rear cover portion for covering at least a substantial portion of the air pervious surface of the rear portion of the press buck, said rear cover portion being less air pervious than said front cover portion, wherein the vacuum applied to the garment through the air pervious surface of the rear portion of the press buck is communicated through said rear cover portion, and wherein a vacuum of lesser force is applied to the garment through said rear cover portion than the vacuum applied to the garment through said front cover portion.

14. The cover system of claim 13 wherein said rear cover portion includes a barrier sheet dimensioned to cover at least a substantial portion of the air pervious surface of the rear portion of the press buck, wherein said barrier sheet reduces the force of the vacuum applied to the garment through the air pervious surface of the rear portion of the press buck relative to the force applied to the garment through the air pervious surface of the front portion of the press buck.

15. The cover system of claim 14 wherein said cover system includes a flannel layer having a front portion covering at least a substantial portion of the front portion of the press buck, and having a rear portion covering at least a substantial portion of the rear portion of the press buck, and wherein said barrier sheet is disposed over at least a substantial portion of said rear portion of said flannel layer.

16. The cover system of claim 15 wherein said cover system includes an outer cover having a front portion for covering at least a substantial portion of said front portion of said flannel layer, and having a rear portion for covering at least a substantial portion of said barrier sheet.

17. The cover system of claim 14 wherein said barrier sheet is provided with securing means for securing said barrier sheet to said press buck.

18. The cover system of claim 14 for use on a press buck having opposite shoulder portions and opposite side portions, wherein said barrier sheet defines opposite shoulder portions which are received over the shoulder portions of the buck, and defines opposite side portions which extend at least partially around the side portions of the press buck.

19. The cover system of claim 18 wherein said barrier sheet is provided with securing means for securing said barrier sheet to said press buck.

20. The cover system of claim 14 wherein said barrier sheet is fabricated of a woven material.

21. The cover system of claim 20 wherein said woven material is a spun nylon fabric.

* * * * *